United States Patent [19]

Snyderman

[11] 4,249,276

[45] Feb. 10, 1981

[54] INFLATABLE SAILBOAT

[76] Inventor: Fredric Snyderman, 6 Franklin Rd., Sharon, Mass. 02067

[21] Appl. No.: 46,219

[22] Filed: Jun. 7, 1979

[51] Int. Cl.[3] ..... B63B 7/00

[52] U.S. Cl. ..... 9/2 A; 114/102

[58] Field of Search ..... 114/39, 102; 9/2 A, 9/11 A

[56] References Cited

U.S. PATENT DOCUMENTS

| | | | |
|---|---|---|---|
| 2,804,633 | 9/1957 | Taylor et al. | 9/11 A |
| 4,149,481 | 4/1979 | Leber | 114/39 |

FOREIGN PATENT DOCUMENTS

| | | | |
|---|---|---|---|
| 1186357 | 1/1965 | Fed. Rep. of Germany | 9/11 A |
| 1808211 | 7/1970 | Fed. Rep. of Germany | 114/39 |
| 2620517 | 11/1977 | Fed. Rep. of Germany | 114/39 |

*Primary Examiner*—Duane A. Reger

*Attorney, Agent, or Firm*—Thompson, Birch, Gauthier & Samuels

[57] ABSTRACT

A sailboat with an inflatable compartment defining a hull and having a plurality of interconnected tubular members forming a support structure for a mast. A plurality of brackets are mounted to the hull for captively holding the tubular members in a substantially A-frame configuration. A sail is connected to the mast which is captively held to the support structure and hull.

10 Claims, 2 Drawing Figures

INFLATABLE SAILBOAT

BACKGROUND OF THE INVENTION

1. Field of the Invention

The present invention relates to sailboats and, more particularly, is directed towards inflatable sailboats.

2. Description of the Prior Art

Inflatable boats of various configurations have been designed to meet the increasing recreational market. In the manufacture of inflatable sailboats, difficulties have been encountered in providing a suitable support system for the mast. Conventional mounting techniques for securing the mast are not suitable for inflatable structures. Complex and costly sail support systems have met varying degrees of success. A need exists for a simple and stable sail support structure for an inflatable boat.

SUMMARY OF THE INVENTION

It is an object of the present invention to provide a sail support structure for an inflatable boat.

Another object of the present invention is to provide a simple and stable support structure for securely mounting a mast that carries a sail to an inflatable hull. The sail support structure is characterized by a plurality of tubular members that are interconnectable with one another in a locking arrangement to form a substantially A-shaped frame having extending feet. A plurality of ring brackets disposed along the hull sides are configured to receive and to captively hold the extending feet of the frame. One end of the mast is secured to a bracket on the hull and an intermediate section of the mast is fastened to an upright triangular portion of the frame.

The invention accordingly comprises the device, together with its parts, elements and interrelationships that are exemplified in the following disclosure, the scope of which will be indicated in the appended claims.

BRIEF DESCRIPTION OF THE DRAWINGS

A fuller understanding of the nature and objects of the present invention will become apparent upon consideration of the following detailed description taken in connection with the accompanying drawings, wherein.

DETAILED DESCRIPTION OF THE PREFERRED EMBODIMENTS

Figure 1:
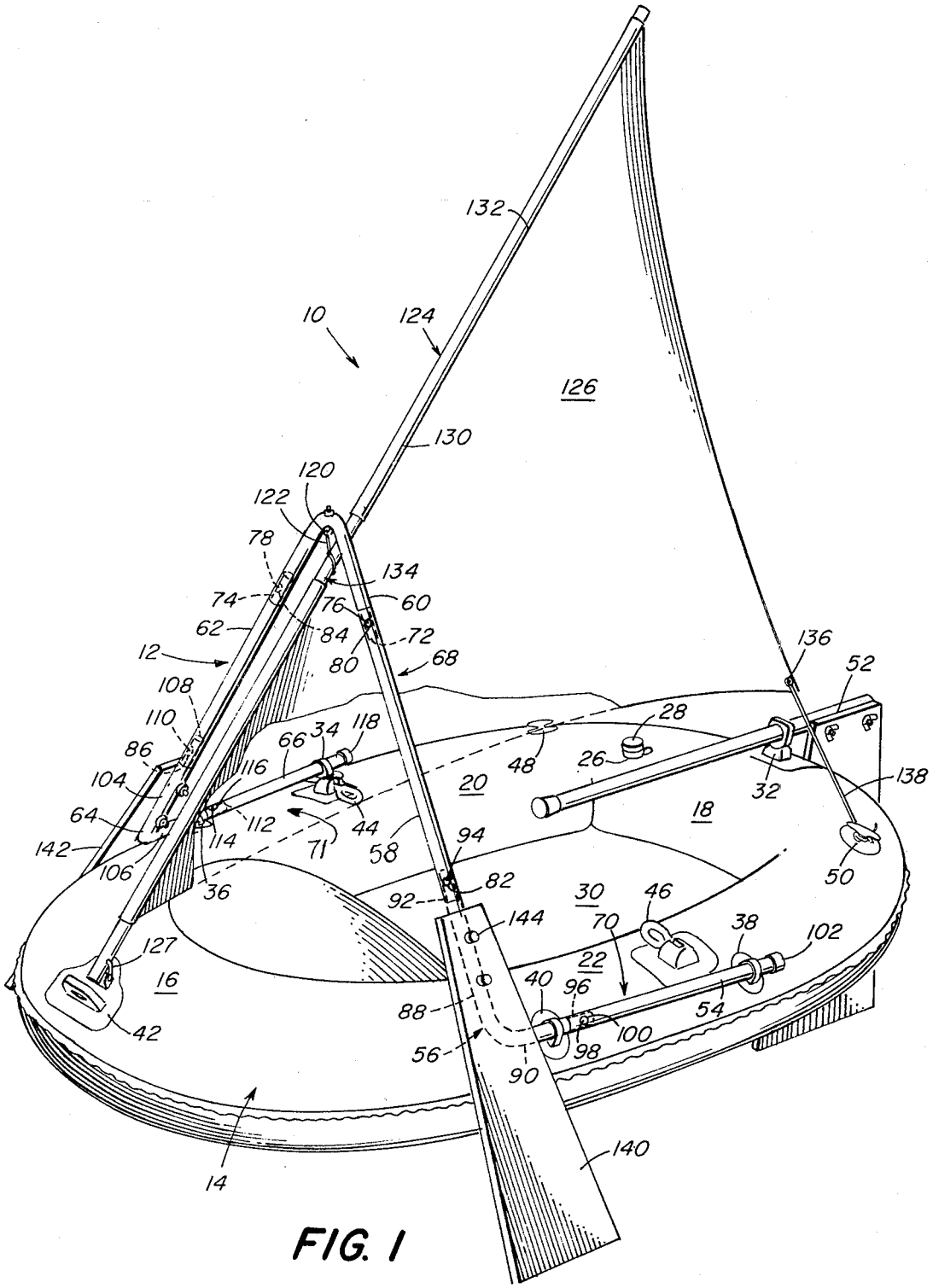
FIG. 1 is a perspective view of an inflatable sailboat embodying the invention.

Referring now to FIG. 1, there is shown a sailboat 10 with a sail support structure 12 embodying the present invention. Sailboat 10 includes an inflatable hull 14 with a bow 16, a stern 18 and sides 20, 22. Hull 14 is composed of a non-porous flexible material, for example, an elastomer such as a natural or synthetic rubber, or a polymer such as polyvinyl chloride or nylon. In the illustrated embodiment, hull 14 is a single chamber, closed loop structure having a continuously curved contour which is inflated and deflated by means of a valve 24 that is provided with a stopper 26. In an alternative embodiment, hull 14 is a multiple chamber structure, each chamber having its own inflation and deflation valve. A non-porous, flexible sheet 28 is fastened to hull 14 to form a floor 29 of a passenger compartment 30. Sheet 28 is composed of an elastomer such as a natural or synthetic rubber, or a polymer such as polyvinyl chloride or nylon. In an alternative embodiment, floor 29 includes a plurality of inflatable chambers. In the preferred embodiment, hull 14 and sheet 28 are composed of polyvinyl chloride and the peripheral margin of sheet 28 is secured to hull 14 by welding a continuous seam. Hull 14 is provided with a pivotable stern bracket 32; starboard ring brackets 34, 36; port ring brackets 38, 40; a bow bracket 42; oarlocks 44, 46; and a pair of cleats 48, 50. A rudder 52 is captively held in stern bracket 32. Starboard brackets 34, 36 and port brackets 38, 40 are configured to captively hold sail support structure 12.

Figure 2:
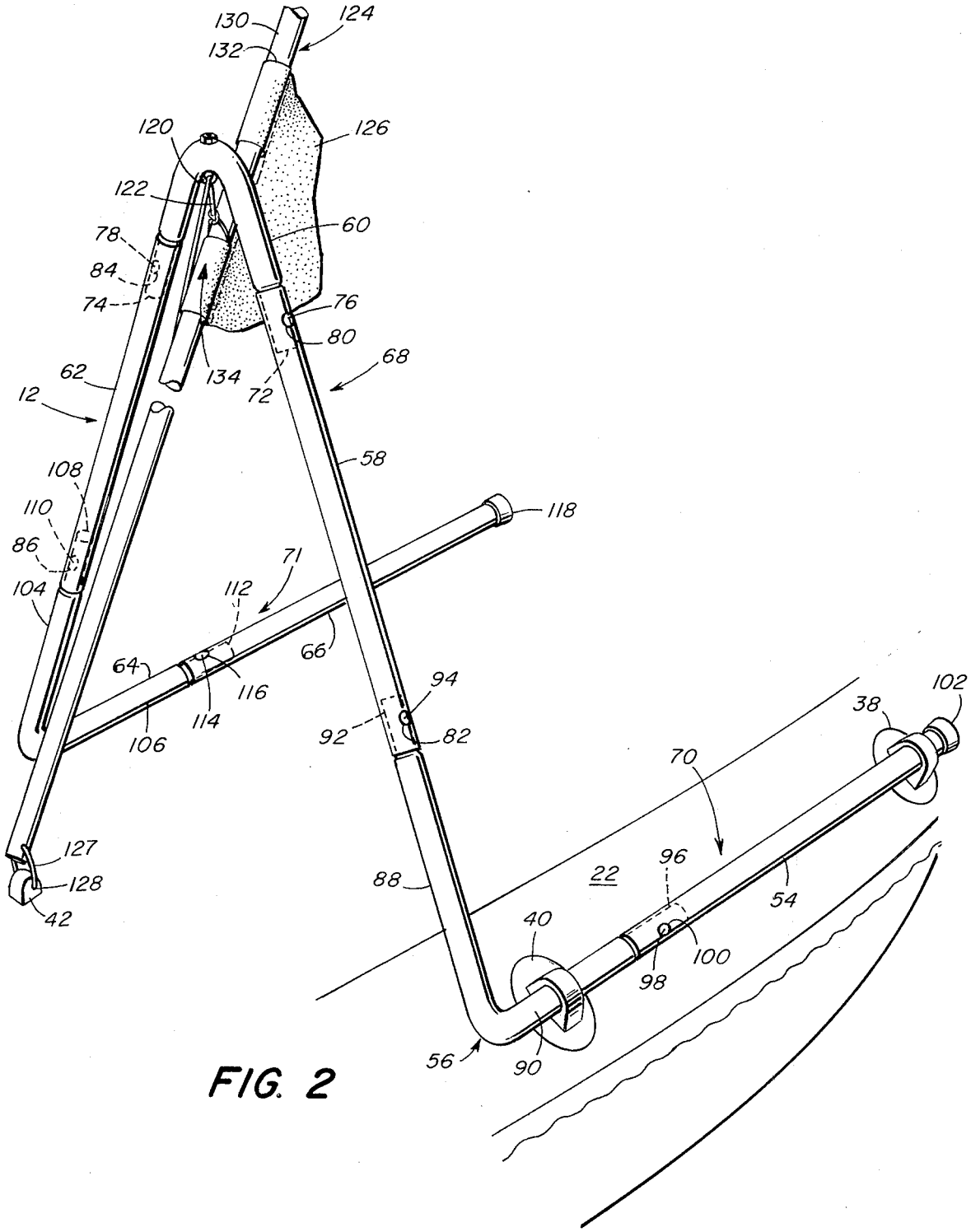
FIG. 2 is a perspective view of the sail structure support of FIG. 1.

As shown in FIG. 2, sail support structure 12 includes a plurality of similar diameter tubular members 54, 56, 58, 60, 62, 64 and 66 that are interconnected in a locking arrangement to form a substantially A-shaped frame with a substantially triangular-shaped body 68 that terminates in a pair of extending feet 70, 71 that are substantially perpendicular to the body. Tubular member 60, which forms the top of triangular body 68, is a substantially triangular member having narrowed end portions 72 and 74 that are provided with locking devices 76 and 78, respectively. Tubular members 58 is a substantially straight member that is formed with holes 80 and 82 adjacent its ends. Locking device 76, for example a spring loaded button, engages hole 80 at the upper end of tubular member 58 when narrowed end 72 of tubular member 60 is inserted into tubular member 58. When spring loaded button 76 is received in hole 80, tubular members 58 and 60 are fixed against relative rotational and slidable movement. Tubular member 62 is a substantially straight member that is formed with holes 84 and 86 adjacent its ends. Locking device 78, for example a spring loaded button, engages hole 84 at the upper end of tubular member 62 when narrowed end 74 of tubular member 60 is inserted into tubular member 62. When spring loaded button 78 is received in hole 84, tubular members 60 and 62 are fixed against relative rotational and slidable movement.

Tubular member 56 is a substantially L-shaped member having an upright leg 88 and a horizontal foot 90. The end of leg 88, which is narrowed at 92 to fit into the lower end of tubular member 58, is provided with a locking device 94, for example a spring loaded button. When narrow end 92 is inserted into tubular member 58 and spring loaded button 94 is received in hole 82, tubular members 56 and 58 are fixed against relative rotational and slidable movement. The end of foot 90, which is narrowed at 96, is provided with a locking device 98, for example a spring loaded button. Tubular member 54 is a substantially straight member which is formed with a hole 100 at one end that is configured to receive spring loaded button 98. When narrow end 96 is inserted into tubular member 54, spring loaded button 98 snaps into hole 100, whereby tubular members 54 and 56 are fixed against relative rotational and slidable movement. The free end of tubular member 54 is provided with a cap 102.

Tubular member 64 is a substantially L-shaped member having an upright leg 104 and a horizontal foot 106. The end of leg 104 which is narrowed at 108 to fit into the lower end of tubular member 62, is provided with a locking device 110, for example a spring loaded button. When narrow end 108 is inserted into tubular member 62 and spring loaded button 110 is received in hole 86, tubular members 62 and 64 are fixed against relative rotational and slidable movement. The end of foot 106, which is narrowed at 112, is provided with a locking device 114, for example a spring loaded button. Tubular member 66 is a substantially straight member that is formed with a hole 116 at one end which is configured to receive spring loaded button 114. When narrow end 112 is inserted into tubular member 66, spring loaded button 114 snaps into hole 116, whereby tubular members 64 and 66 are fixed against relative rotational and slidable movement. The free end of tubular member 66 is provided with a cap 118.

As shown in FIG. 1, foot 90 is captively held in port ring bracket 40 and tubular member 54 is captively held in port ring bracket 38. In a similar manner, foot 106 and tubular member 66 are captively held in starboard ring brackets 36 and 34, respectively. A fastener 120, for example an eyebolt, is provided at the peak of tubular member 60. A line 122, which is attached to a mast 124 that carries a sail 126, is secured to eyebolt 120. The lower end of mast 124 is captively held to bow bracket 42 by means of a fastener 127, for example a pin, that is threaded through the bow bracket and a hole 128 formed in the lower end of the mast. In the illustrated embodiment, by way of example, mast 124 includes a plurality of tubular members 130 that are interconnected with locking devices of the type described in connection in sail support structure 12. The leading edge of sail 126 is sewn to form a pocket 132 into which mast 124 is threaded. Pocket 132 is cutaway at 134 to permit fastening line 122 directly to mast 124. The lower rear corner of sail 126 is provided with an eyelet 136 to which a line 138 is attached. Proper positioning of sail 126 is maintained by securing line 138 to cleats 48 or 50. For additional stability of sailboat 10, outriggers 140 and 142 are attached to legs 88 and 104 respectively by means of screws 144, for example.

From the foregoing, it will be readily apparent that sail structure 12 and mast 124 are easily assembled and disassemblied. In order to disassemble the tubular members, the spring loaded button associated therewith is depressed out of its locking hole and the tubular members are pulled apart.

Since certain changes may be made in the foregoing disclosure without departing from the scope of the invention herein involved, it is intended that all matter contained in the above description and depicted in the accompanying drawings be construed in an illustrative and not in a limiting sense.

What is claimed is:

1. An inflatable sailboat comprising:

(a) an inflatable hull;

(b) starboard bracket means mounted to said hull on the starboard side thereof;

(c) port bracket means mounted to said hull on the port side thereof;

(d) bow bracket means mounted to said hull at the bow thereof;

(e) an A-frame with a substantially triangular upright body that terminates in a pair of rearwardly extending feet which are substantially perpendicular to said upright body, one of said extending feet received within said starboard bracket means and captively held to said hull by said starboard bracket means, the other of said extending feet received within said port bracket means and captively held to said hull by said port bracket means;

(f) a mast, one end of said mast configured to be captively held by said bow bracket means, a portion of said mast intermediate its ends captively mounted to the apex of said triangular body, said mast sloping obliquely upward from said bow bracket means to its mounting at said apex of said triangular body; and (g) sail means carried by said mast.

2. The inflatable sailboat as claimed in claim 1 wherein said A-frame includes a plurality of interlocking members.

3. The inflatable sailboat as claimed in claim 2 wherein said interlocking members are tubular members of substantially similar diameters, certain ones of said tubular members having narrowed ends that are configured to be received by certain other ones of said tubular members.

4. The inflatable sailboat as claimed in claim 2 wherein said starboard bracket means includes a pair of ring brackets and wherein said port bracket means includes a pair of ring brackets, said extending feet received within said ring brackets.

5. The inflatable sailboat as claimed in claim 4 wherein said A-frame includes a plurality of interconnectable tubular members, said tubular members fixed against relative slidable and rotational movement when interconnected, said tubular members defining said extending feet captively held by said ring brackets.

6. An inflatable sailboat comprising:

(a) an inflatable hull;

(b) a plurality of bracket means mounted to said hull along the sides thereof;

(c) a sail support structure having a substantially triangular body with a pair of feet rearwardly extending substantially perpendicular from said body, said feet received within said bracket means and captively held by said bracket means, said body being substantially upright with respect to said hull when said feet are captively held by said bracket means, said feet substantially parallel with respect to said hull when held by said bracket means;

(d) mast means, one end of said mast means mounted to the bow of said hull, a portion of said mast means intermediate the ends thereof connected to the apex of said body, said mast means sloping obliquely upward from said bow to said apex of said body; and (e) sail means connected to said mast.

7. The inflatable sailboat as claimed in claim 6 wherein said A-frame includes a plurality of interconnectable tubular members of substantially equal diameters, certain ends of said members narrowed to fit into certain other ones of said members, said tubular members defining said extending feet captively held to said hull by said bracket means, one of said extending feet captively held to the starboard side of said hull and the other one of said extending feet captively held to the port side of said hull, said feet extending towards the stern of said hull.

8. The inflatable sailboat as claimed in claim 7 wherein certain ones of said tubular members have narrowed ends that are received within certain other ones of said tubular members for interconnecting said tubular members.

9. The inflatable sailboat as claimed in claim 8 including locking means for locking said interconnected tubular members, said locked interconnected tubular members are fixed against rotational and slidable movement relative to one another.

10. The inflatable sailboat as claimed in claim 9 including first and second outrigger means, said first outrigger means connected to said body on the starboard side of said hull, said second outrigger means connected to said body on the port side of said hull, said first and second outrigger means substantially parallel to the respective sides of said upright body.

* * * * *